US010670313B2

(12) United States Patent
Nishida

(10) Patent No.: US 10,670,313 B2
(45) Date of Patent: Jun. 2, 2020

(54) INTERNAL TEMPERATURE ADJUSTING DEVICE

(71) Applicant: DENSO CORPORATION, Kariya, Aichi-pref. (JP)

(72) Inventor: Yasushi Nishida, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 72 days.

(21) Appl. No.: 15/776,323

(22) PCT Filed: Nov. 4, 2016

(86) PCT No.: PCT/JP2016/082744
§ 371 (c)(1),
(2) Date: May 15, 2018

(87) PCT Pub. No.: WO2017/086183
PCT Pub. Date: May 26, 2017

(65) Prior Publication Data

US 2018/0356135 A1 Dec. 13, 2018

(30) Foreign Application Priority Data

Nov. 18, 2015 (JP) ..... 2015-225504

(51) Int. Cl.
*F25B 39/00* (2006.01)
*F25D 11/00* (2006.01)
(Continued)

(52) U.S. Cl.
CPC ..... *F25B 39/00* (2013.01); *B65D 88/744* (2013.01); *F25B 13/00* (2013.01); *F25B 49/02* (2013.01);
(Continued)

(58) Field of Classification Search
CPC ..... F25B 39/00; F25B 47/025; B65D 88/745; F25D 3/06; F25D 11/00; F25D 11/003
See application file for complete search history.

(56) References Cited

U.S. PATENT DOCUMENTS

2009/0113914 A1* 5/2009 Kitano ..... B60H 1/3226 62/239
2018/0266743 A1* 9/2018 Watanabe ..... F25B 47/02

FOREIGN PATENT DOCUMENTS

JP H06034256 A 2/1994
JP H06028576 U 4/1994
(Continued)

*Primary Examiner* — Elizabeth J Martin
(74) *Attorney, Agent, or Firm* — Harness, Dickey & Pierce, P.L.C.

(57) ABSTRACT

An internal temperature adjusting device includes a heat pump, an internal heat exchanger, and an external heat exchanger. The internal heat exchanger is configured to function as one of an evaporator or a condenser of the heat pump, and exchange heat between a heat medium and air inside the container. The external heat exchanger is configured to function as the other one of the evaporator or the condenser, and exchange heat between the heat medium and air outside the container. The external heat exchanger includes a plurality of heat exchanging members separated from each other. According to the internal temperature adjusting device, drainage of the external heat exchanger as a whole can be secured.

4 Claims, 7 Drawing Sheets

(51) Int. Cl.

| | |
|---|---|
| ***F25D 19/00*** | (2006.01) |
| ***F25D 21/06*** | (2006.01) |
| ***F25D 23/00*** | (2006.01) |
| ***F25B 49/02*** | (2006.01) |
| ***F25B 13/00*** | (2006.01) |
| ***F25D 21/14*** | (2006.01) |
| ***B65D 88/74*** | (2006.01) |
| ***F25B 27/00*** | (2006.01) |
| ***F25B 47/02*** | (2006.01) |

(52) U.S. Cl.

CPC ..... *F25D 11/00* (2013.01); *F25D 19/00* (2013.01); *F25D 21/06* (2013.01); *F25D 21/14* (2013.01); *F25D 23/00* (2013.01); *F25B 27/00* (2013.01); *F25B 47/025* (2013.01); *F25B 2313/0254* (2013.01); *F25B 2313/0294* (2013.01); *F25B 2327/001* (2013.01); *F25B 2500/01* (2013.01); *F25B 2600/11* (2013.01); *F25B 2700/172* (2013.01); *F25D 2321/14* (2013.01)

(56) References Cited

FOREIGN PATENT DOCUMENTS

| | | | |
|---|---|---|---|
| JP | 2004286363 | A | 10/2004 |
| JP | 2013217506 | A | 10/2013 |
| JP | 2015010766 | A | 1/2015 |

* cited by examiner

INTERNAL TEMPERATURE ADJUSTING DEVICE

CROSS REFERENCE TO RELATED APPLICATIONS

This application is a U.S. National Phase Application under 35 U.S.C. 371 of International Application No. PCT/JP2016/082744 filed on Nov. 4, 2016 and published in Japanese as WO 2017/086183 A1 on May 26, 2017. This application is based on and claims the benefit of priority from Japanese Patent Application No. 2015-225504 filed on Nov. 18, 2015. The entire disclosures of all of the above applications are incorporated herein by reference.

TECHNICAL FIELD

The present disclosure relates to an internal temperature adjusting device that includes a heat pump and regulates a temperature inside a container.

BACKGROUND ART

As a conventional device with a heat pump, Patent Document 1 discloses a water heater. The water heater of Patent Document 1 includes a heat exchanger that functions as an evaporator evaporating a refrigerant, and a blower fan that sends outside air to the heat exchanger. The heat exchanger is inclined with respect to a flow of the outside air toward a downstream side. According to this, since condensed water on the heat exchanger is moved on the heat exchanger by wind power of the outside air sent by the blower fan, drainage of the condensed water can be improved.

In recent years, as a kind of a conex box transported by a trailer or the like, there is a container for housing fresh food and frozen food in a cooled condition. The container includes an internal temperature adjusting device that maintains inside temperature at a target temperature. The internal temperature adjusting device includes a heat pump, for example. The internal temperature adjusting device with the heat pump includes an internal heat exchanger that exchanges heat between a heat medium and air inside the container, and an external heat exchanger that exchanges heat between the heat medium and air outside the container. In a cooling operation, the internal temperature adjusting device decreases temperature inside the container by using the internal heat exchanger as an evaporator, and by using the external heat exchanger as a condenser. In a heating operation, the internal temperature adjusting device increases temperature inside the container by using the internal heat exchanger as a condenser, and by using the external heat exchanger as an evaporator.

In the internal temperature adjusting device, condensed water is generated on the external heat exchanger when the heating operation is performed. When the trailer transporting the container runs in a cold area, for example, the condensed water generated on the external heat exchanger may become frost. Since the frost decreases a heat exchange capacity of the external heat exchanger, the internal temperature adjusting device periodically performs a defrosting operation by temporarily performing the cooling operation. According to this, the external heat exchanger is heated, and the frost on the external heat exchanger is melted and removed. When the condensed water remains on the external heat exchanger after the defrosting operation, frost is generated again after restarting the heating operation. Accordingly, the external heat exchanger needs to have a high drainage.

It may be considered to adopt the structure of the heat exchanger of Patent Document 1 as the structure of the external heat exchanger. That is, it may be considered to improve drainage of the external heat exchanger by providing the external heat exchanger so as to incline with respect to a vertical direction. However, since a space in the container for the external temperature adjusting device is limited, it may be difficult to secure a space for inclining the external heat exchanger.

PRIOR ART DOCUMENT

Patent Document

Patent Document 1: JP 2015-10766 A

SUMMARY OF THE INVENTION

In consideration of the above-described points, it is an objective of the present disclosure to provide an internal temperature adjusting device which is capable of securing drainage of an external heat exchanger even when a space for the external heat exchanger is limited.

According to an aspect of the present disclosure, an internal temperature adjusting device includes a heat pump, an internal heat exchanger, and an external heat exchanger. The internal heat exchanger is configured to function as one of an evaporator or a condenser of the heat pump, and exchange heat between a heat medium and air inside the container. The external heat exchanger is configured to function as the other one of the evaporator or the condenser, and exchange heat between the heat medium and air outside the container. The external heat exchanger includes a plurality of heat exchanging members separated from each other.

According to this configuration, since the external heat exchanger is separated into multiple heat exchanging members, flexibility in distribution of the external heat exchanger can be increased. Since each heat exchanging member can be provided so as to achieve high drainage, drainage of the external heat exchanger as a whole can be secured.

According to the present disclosure, drainage of the external heat exchanger can be secured even when the space for the external heat exchanger is limited.

EMBODIMENTS FOR EXPLOITATION OF THE INVENTION

Hereinafter, an embodiment of an internal temperature adjusting device will be described below.

Figure 1:
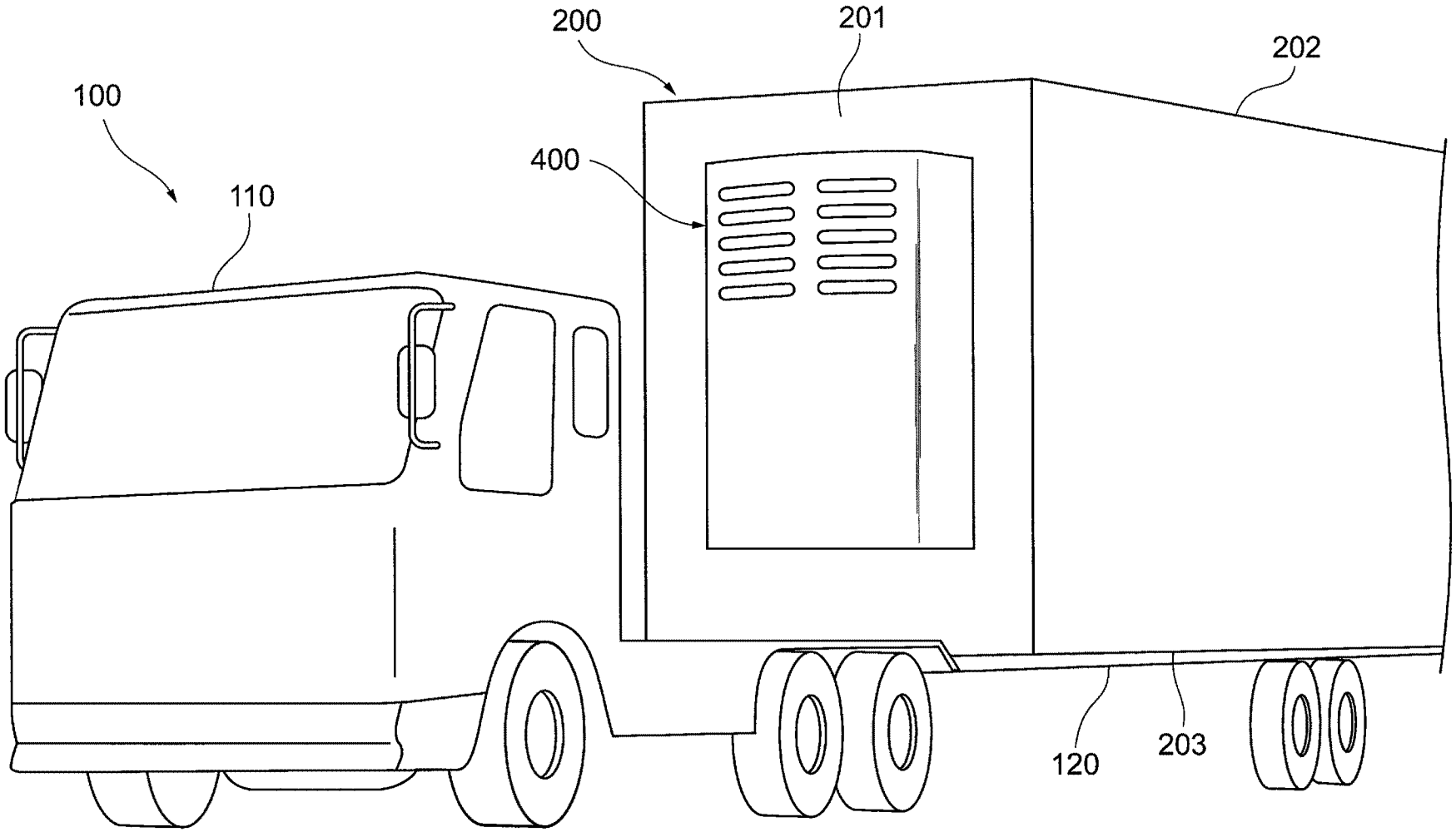
FIG. 1 is a perspective view illustrating a structure of a trailer on which an internal temperature adjusting device is mounted, according to an embodiment of the present disclosure.

As shown in FIG. 1, an internal temperature adjusting device 400 according to the present embodiment is mounted on a container 200 transported by a trailer 100. The container 200 is stacked on a towed vehicle 120 towed by a towing vehicle 110 of the trailer 100.

The container 200 is made of metal material and has a box shape. Goods that require temperature management such as fresh food, frozen food, and medicine are stored in the container 200. When the container 200 is stacked on the towed vehicle 120, a ceiling surface 202 of the container 200 is parallel to a horizontal direction, and a lateral surface 201 is parallel to a vertical direction.

The internal temperature adjusting device 400 is mounted on the lateral surface 201 of the container 200 which faces a vehicle traveling direction. The internal temperature adjusting device 400 is configured to maintain a temperature inside the container 200 at a target temperature by using a heat pump. The target temperature is set by a driver of the trailer 100, for example. Specifically, when the temperature inside the container 200 is higher than the target temperature, the internal temperature adjusting device 400 decreases the temperature inside the container 200 by cooling air inside the container 200 such that the temperature inside the container 200 approaches the target temperature. When the trailer 100 is running in a cold area, the temperature inside the container 200 may be lower than the target temperature. In such case, the internal temperature adjusting device 400 increases the temperature inside the container 200 by heating air inside the container 200 such that the temperature inside the container 200 approaches the target temperature.

Next, the structure of the internal temperature adjusting device 400 will be described in detail.

Figure 2:
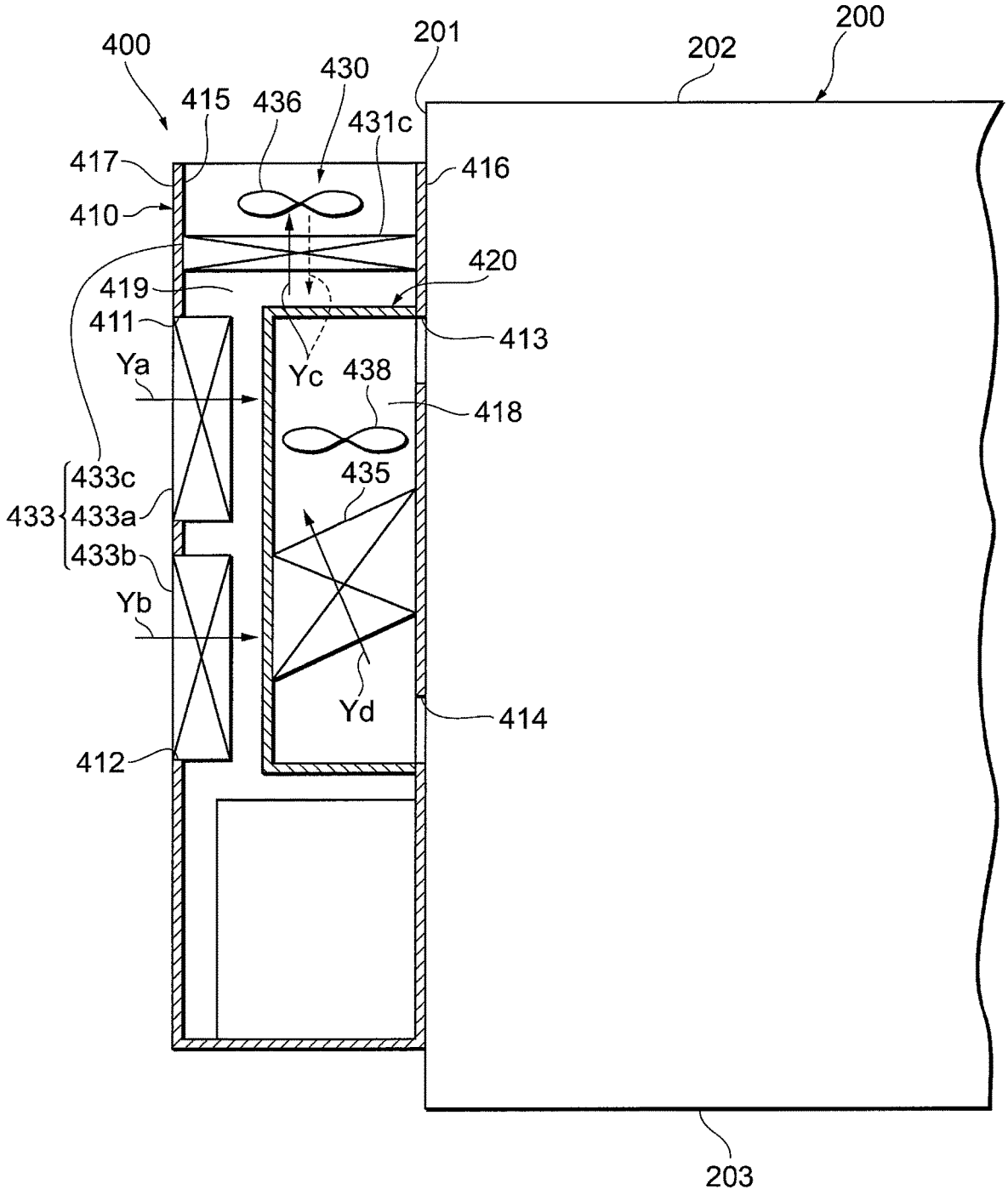
FIG. 2 is a cross-sectional diagram illustrating a structure of the internal temperature adjusting device according to the embodiment.

As shown in FIG. 2, the internal temperature adjusting device 400 includes a housing 410, a shielding member 420, and a heat pump 430.

The housing 410 has a box shape. An opening portion 415 is provided in an upper part of the housing 410. A first lateral wall 416 of the housing 410 is fixed to the container 200. The shielding member 420 is fixed to an inner face of the first lateral wall 416 of the housing 410. The shielding member 420 has a box shape. The shielding member 420 is made of resin material having a high thermal insulation performance, for example. An internal air passage 418 is defined by the inner face of the first lateral wall 416 of the housing 410 and an inner face of the shielding member 420. An inside space of the housing 410 excepting the internal air passage 418 is an outside air passage 419.

The first lateral wall 416 of the housing 410 has inside through-holes 413, 414 extending from the inside air passage 418 to the inside space of the container 200. The inside through-hole 413 is located in an end part on the ceiling surface 202 side of the inside air passage 418. The inside through-hole 414 is located in an end part on a bottom surface 203 of the container 200 side of the inside air passage 418. The inside space of the container 200 and the inside air passage 418 communicate with each other through the inside through-hole 413, 414. An internal heat exchanger 435 and an internal fan 438 are provided in the internal air passage 418. The internal fan 438 is closer to the ceiling surface 202 of the container 200 compared to the internal heat exchanger 435. The internal fan 438 is configured to send air in the internal air passage 418 toward the internal heat exchanger 435. The internal heat exchanger 435 is configured to exchange heat between a heat medium therein and the air flowing through the internal air passage 418. That is, the internal heat exchanger 435 is configured to exchange heat between the heat medium therein and the air inside the container 200.

A second lateral wall 417 of the housing 410 that faces to the first lateral wall 416 has outside through-holes 411, 412 extending from the external air passage 419 to an outside of the housing 410. A space outside the container 200 and the external air passage 419 communicate with each other through the outside through-holes 411, 412. A heat exchanging member 433*a* is provided in the outside through-hole 411, and a heat exchanging member 433*b* is provided in the outside through-hole 412. A heat exchanging member 433*c* and an external fan 436 are provided in the opening portion 415 of the external air passage 419 of the housing 410. The external fan 436 is closer to the ceiling surface 202 of the container 200 compared to the heat exchanging member 433*c*. That is, the external fan 436 is located above the heat exchanging member 433*c* in the vertical direction. The heat exchanging members 433*a*, 433*b*, 433*c* constitute an external heat exchanger 433. That is, the external heat exchanger 433 is constituted by three separate heat exchanging members 433*a*, 433*b*, 433*c*. Specifically, three separate heat exchanging members 433*a*, 433*b*, 433*c* are separated and spaced away from each other as shown in FIG. 2. The external fan 436 sends air in the external air passage 419 toward the heat exchanging members 433*a*, 433*b*, 433*c*. The external heat exchanger 433 is configured to exchange heat between a heat medium therein and the air in the external air passage 419. That is, the external heat exchanger 433 is configured to exchange heat between the heat medium therein and the air outside the container 200.

Next, structures of the heat exchanging members 433*a*, 433*b*, 433*c* and the internal heat exchanger 435 will be described in detail. Since the heat exchanging members 433*a*, 433*b*, 433*c* and the internal heat exchanger 435 have substantially the same structure, the structure of the heat exchanging member 433*a* will be described.

Figure 3:
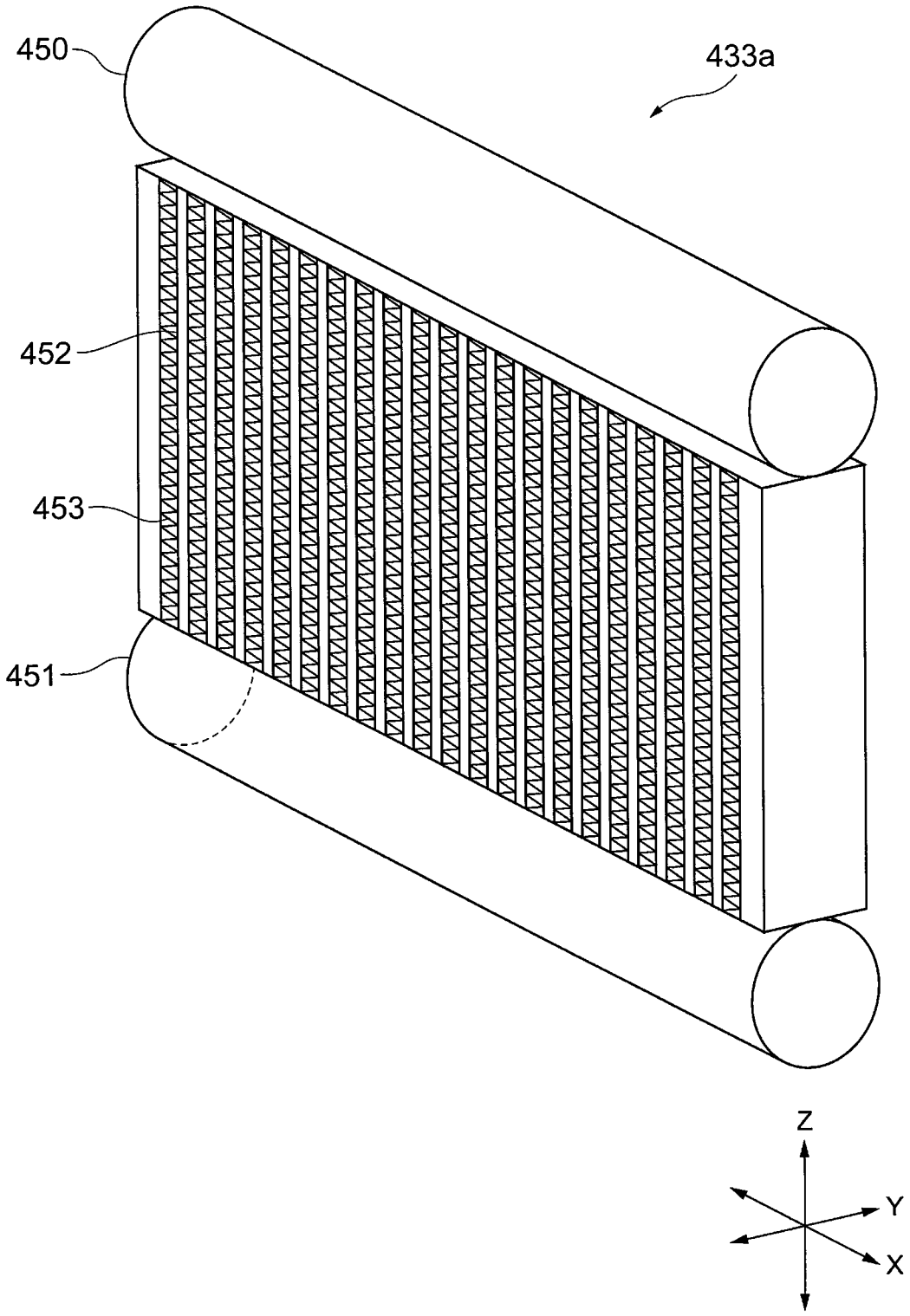
FIG. 3 is a diagram schematically illustrating a heat exchange member of the internal temperature adjusting device according to the embodiment.

As shown in FIG. 3, the heat exchanging member 433*a* includes header tanks 450, 451, tubes 452, and fins 453.

The header tanks 450, 451 are in parallel with a direction indicated by an arrow X. The header tanks 450, 451 are spaced away from each other in a direction indicated by an arrow Z. Multiple tubes 452 are aligned along the direction indicated by the arrow X and spaced away from each other. The tubes 452 are between the header tank 450 and the 451. Hereinafter, the direction indicated by the arrow X is referred to as "tube stacking direction". The header tanks 450, 451 are configured to distribute the heat medium to the tubes 452 and collect the heat medium flowing out of the tube 452.

The tube 452 is a long, thin, and flat tube whose lengthwise direction is along the direction indicated by the arrow Z. Hereinafter, the direction indicated by the arrow Z is referred to as "tube lengthwise direction". Ends of the tube 452 in the lengthwise direction are connected to the header tanks 450, 451, respectively. A passage of the heat medium in the tube 452 communicates with inner passages of the header tanks 450, 451. Air flows in a direction indicated by an arrow Y through a gap between adjacent tubes 452. Hereinafter, the direction indicated by the arrow Y is referred to as "air flowing direction". The air flowing direction Y is perpendicular to the tube stacking direction X and the tube lengthwise direction Z.

The fin 453 is provided in the gap between adjacent tubes 452. The fin 453 is so called corrugated fin formed by corrugating a long and thin metal plate. The fin 453 increases a heat transfer area of the heat exchanging member 433*a* to increase a heat transfer capacity.

When the heat medium flows in the tube 452, the heat exchanging member 433*a* exchanges heat between the heat medium and the air flowing around the tube 452. This is the same in the heat exchanging members 433*b*, 433*c*, and the internal heat exchanger 435.

As shown in FIG. 2, the heat exchanging member 433*a* is provided such that the air flows therethrough in a direction indicated by an arrow Ya. The heat exchanging member 433*b* is provided such that the air flows therethrough in a direction indicated by an arrow Yb. That is, the heat exchanging members 433*a*, 433*b* are provided such that the air flows through the heat exchanging members 433*a*, 433*b* in a direction parallel to the ceiling surface 202 of the container 200, i.e. parallel to the horizontal direction.

The heat exchanging member 433*c* is provided such that the air flows through the heat exchanging member 433*c* in a direction indicated by an arrow Yc shown in FIG. 2. That is, the heat exchanging member 433*c* is provided such that the air flows through the heat exchanging member 433*c* in a direction perpendicular to the ceiling surface 202 of the container 200, i.e. parallel to the vertical direction. In the present embodiment, a predetermined direction in which the air flows through the heat exchanging member 433*c* is approximately perpendicular to the ceiling surface 202 of the container 200, i.e. approximately along the vertical direction.

In the present embodiment, the heat exchanging members 433*a*, 433*b* may correspond to an upright heat exchanging member, and the heat exchanging member 433*c* may correspond to an inclined heat exchanging member.

The internal heat exchanger 435 is provided such that the air flows through the internal heat exchanger 435 in a direction indicated by an arrow Yd shown in FIG. 2. That is, the internal heat exchanger 435 is provided such that the air flows through the internal heat exchanger 435 in a direction intersecting with the ceiling surface 202 of the container 200, i.e. intersecting with the horizontal direction.

Next, the structure of the heat pump 430 will be described in detail.

Figure 4:
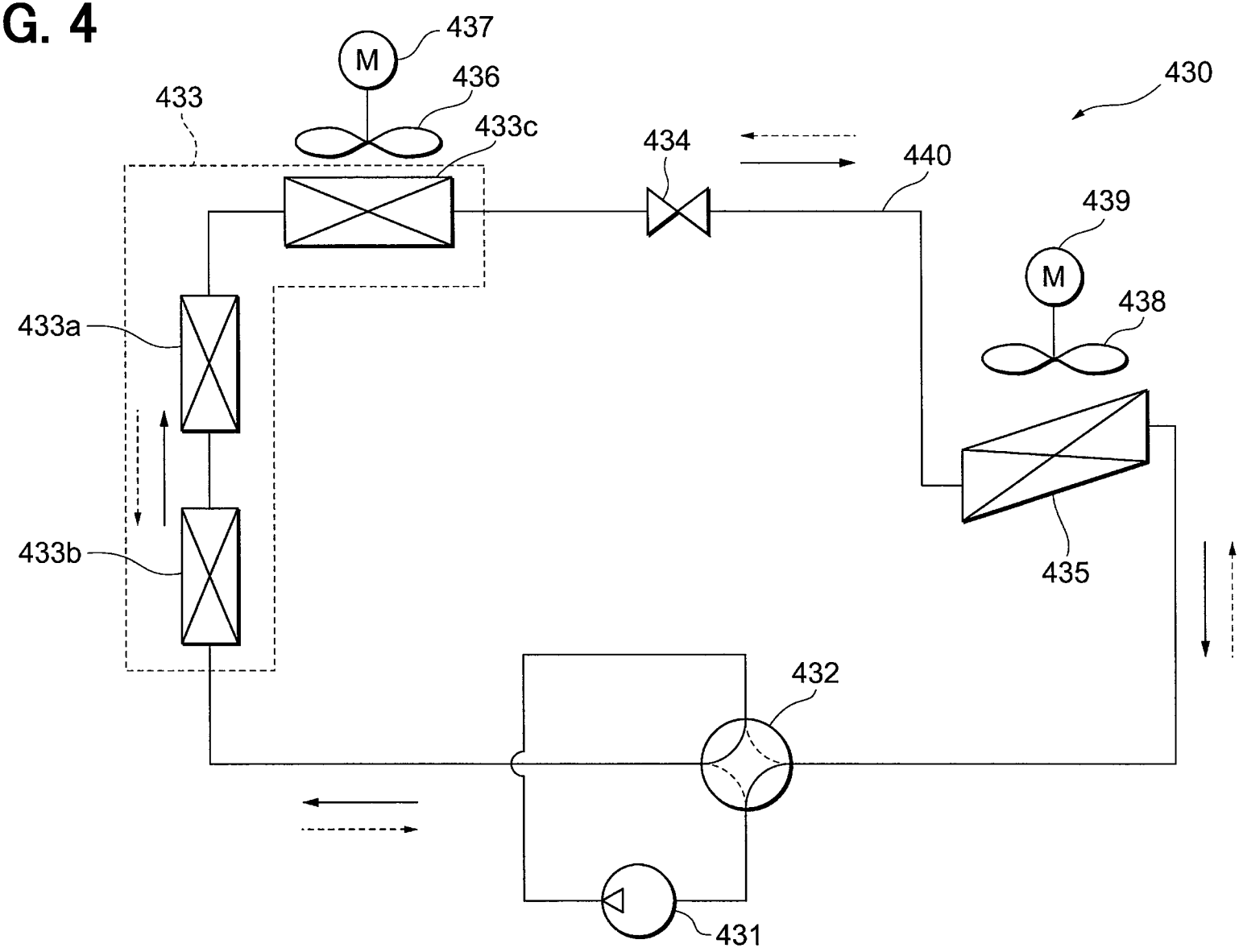
FIG. 4 is a block diagram illustrating a configuration of a heat pump of the internal temperature adjusting device according to the embodiment.

As shown in FIG. 4, the heat pump 430 includes a compressor 431, a four-way valve 432, and an expansion valve 434 in addition to the external heat exchanger 433 constituted by the heat exchanging members 433*a*, 433*b*, 433*c*, the internal heat exchanger 435, the external fan 436, and the internal fan 438. The parts are annularly connected to each other through pipes 440. The heat medium flows through the pipes 440.

The compressor 431 is driven by power of an engine of the trailer 100, or power of an electric motor of the compressor 431. The compressor 431 is configured to draw the heat medium, compress the heat medium, and discharge high-temperature and high-pressure heat medium.

The four-way valve 432 is configured to change a flow direction of the heat medium. Specifically, the four-way valve 432 is configured to switch between a pathway indicated by solid lines and a pathway indicated by dashed lines. When the pathway in the four-way valve 432 is set to be the pathway indicated by the solid lines, the internal heat exchanger 435 is connected to an intake port of the compressor 431, and a discharge port of the compressor 431 is connected to the external heat exchanger 433. In contrast, when the pathway in the four-way valve 432 is set to be the pathway indicated by the dashed lines, the intake port of the compressor 431 is connected to the external heat exchanger 433, and the discharge port of the compressor 431 is connected to the internal heat exchanger 435.

The expansion valve 434 is configured to drastically expand the heat medium to generate low-temperature and low-pressure heat medium.

The external fan 436 is driven by power of an external fan motor 437. The internal fan 438 is driven by power of an internal fan motor 439.

In the heat pump 430, when the pathway in the four-way valve 432 is set to be the pathway indicated by the solid lines, the heat medium flows in a direction indicated by solid arrows in FIG. 4. That is, the heat medium flows through, in order, the compressor 431, the external heat exchanger 433, the expansion valve 434, and the internal heat exchanger 435. In this case, the external heat exchanger 433 functions as a condenser, and the internal heat exchanger 435 functions as an evaporator. That is, the external heat exchanger 433 dissipates heat of the heat medium to the outside of the container 200 by exchanging heat between the air in the external air passage 419 and the high-temperature and high-pressure heat medium compressed by the compressor 431. The internal heat exchanger 435 cools the air inside the container 200 by exchanging heat between the air in the internal air passage 418 and the low-temperature and low-pressure heat medium generated by the expansion valve 434. Hereinafter, an operation condition in which the internal heat exchanger 435 functions as an evaporator is referred to as a cooling operation.

In the heat pump 430, when the pathway in the four-way valve 432 is set to be the pathway indicated by the dashed lines, the heat medium flows in a direction indicated by dashed arrows in FIG. 4. That is, the heat medium flows through, in order, the compressor 431, the internal heat exchanger 435, the expansion valve 434, and the external heat exchanger 433. In this case, the external heat exchanger 433 functions as an evaporator, and the internal heat exchanger 435 functions as a condenser. That is, the external heat exchanger 433 causes the heat medium to absorb heat from the air outside the container 200 by exchanging heat between the air in the external air passage 419 and low-temperature and low-pressure heat medium generated by the expansion valve 434. The internal heat exchanger 435 heats the air inside the container 200 by exchanging heat between the air in the internal air passage 418 and high-temperature and high-pressure heat medium generated by the compressor 431. Hereinafter, an operation condition in which the internal heat exchanger 435 functions as a condenser is referred to as a heating operation.

In the internal temperature adjusting device 400 of the present embodiment, the internal heat exchanger 435 functions as one of an evaporator and a condenser of the heat pump 430, and the external heat exchanger 433 functions as the other one of a condenser and an evaporator of the heat pump 430. According to the internal temperature adjusting device 400 of the present embodiment, the temperature in the container 200 is regulated by cooling and heating the container 200 by using the heat pump 430.

Next, electrical configurations of the internal temperature adjusting device 400 will be described.

Figure 5:
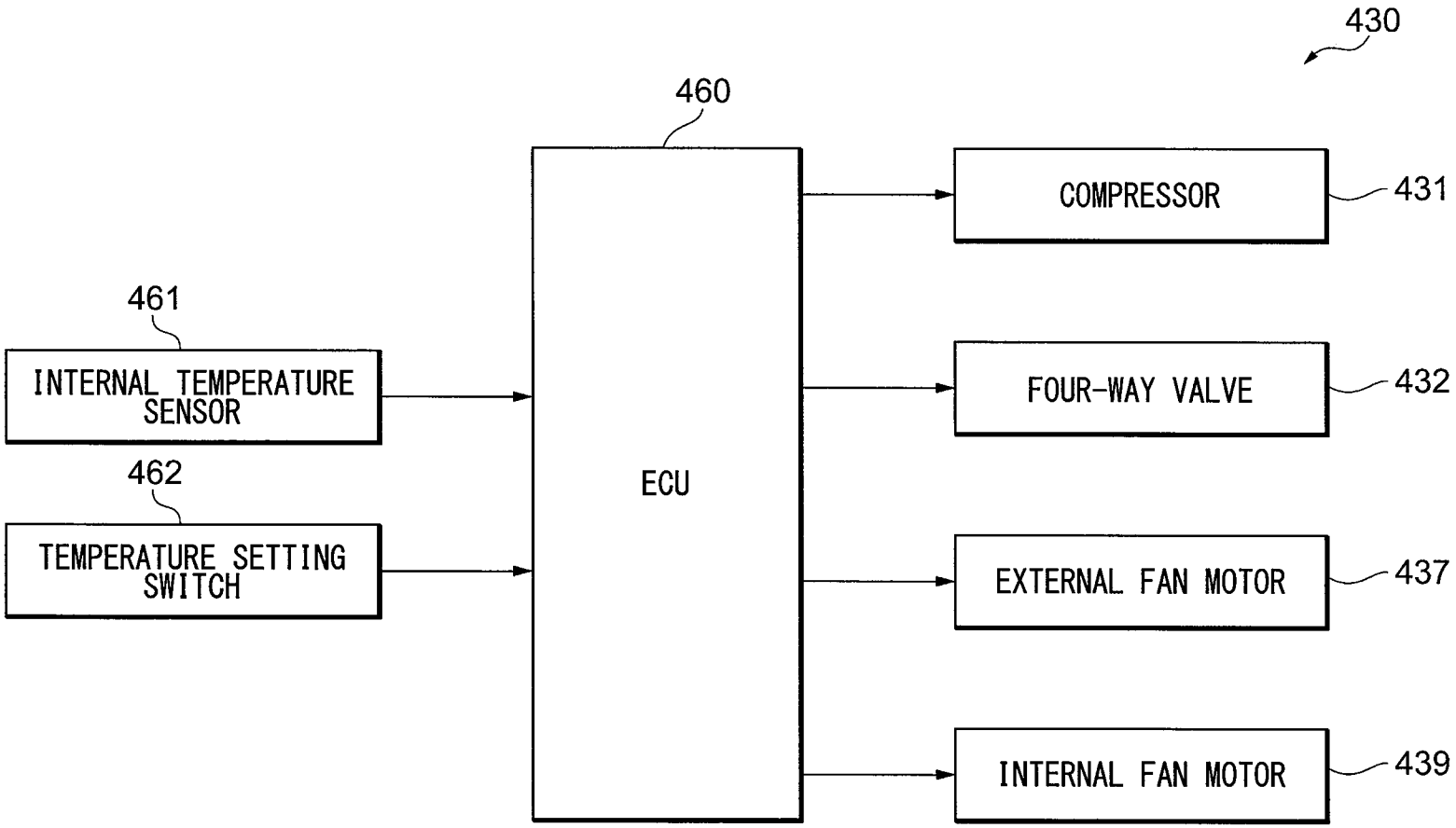
FIG. 5 is a block diagram illustrating an electrical configuration of the internal temperature adjusting device according to the embodiment.

As shown in FIG. 5, the internal temperature adjusting device 400 includes an ECU (Electronic Control Unit) 460, an internal temperature sensor 461, and a temperature setting switch 462. In the present embodiment, the ECU 460 corresponds to a controller.

The internal temperature sensor 461 is configured to detect a temperature in the container 200 and output a detection signal based on the detected temperature. The detection signal of the internal temperature sensor 461 is input to the ECU 460. The ECU 460 is configured to obtain the detection temperature of the container 200 based on the detection signal of the internal temperature sensor 461, and control actuations of the compressor 431, the four-way valve 432, the external fan motor 437, and the internal fan motor 439 based on the temperature in the container 200.

Specifically, the ECU 460 is configured to compare the detected temperature of the container 200 and the target temperature set by the driver of the trailer using the temperature setting switch 462, for example. When the detected temperature of the container 200 is higher than the target temperature, the ECU 460 actuates the compressor 431 and the four-way valve 432 such that the heat pump 430 is in the cooling operation. When the detected temperature of the container 200 is lower than the target temperature, the ECU 460 controls the compressor 431 and the four-way valve 432 such that the heat pump 430 is in the heating operation.

The ECU 460 actuates the internal fan motor 439 to generate an airflow around the internal heat exchanger 435 as indicated by solid lines in FIG. 2. That is, the ECU 460 is configured to generate an airflow flowing from the inside through-hole 414 to the inside through-hole 413 through the internal heat exchanger 435.

When the heat pump 430 is in the cooling operation or the heating operation, the ECU 460 actuates the external fan motor 437 to generate airflow around the external heat exchanger 433 indicated by the solid line in FIG. 2. That is, the ECU 460 is configured to generate an airflow flowing from the external air passage 419 to the outside through the heat exchanging member 433*c* and the opening portion 415 of the housing 410. Accordingly, an airflow caused by the vehicle running and flowing into the internal air passage 418 through the heat exchanging members 433*a*, 433*b* from the outside of the container 200 flows through the heat exchanging member 433*c*. Since the flow rate of the air flowing through the heat exchanging members 433*a*, 433*b*, 433*c* can be increased by the airflow caused by the vehicle running, heat exchange rate of the heat exchanging members 433*a*, 433*b*, 433*c* can be improved.

When the heat pump 430 is in the heating operation, the external heat exchanger 433 functions as an evaporator, and accordingly a condensed water may be generated on the external heat exchanger 433. Accordingly, when the trailer 100 runs in a cold area, for example, frost may occur on the external heat exchanger 433 due to the condensed water generated on the external heat exchanger 433. Since the frost decreases the heat exchange rate of the external heat exchanger 433, it may be preferable to remove the frost.

When the heat pump 430 is in the heating operation, the ECU 460 of the present embodiment periodically performs a defrosting operation. In the defrosting operation, the heat pump 430 is temporarily in the cooling operation, and the external heat exchanger 433 functions as a condenser, and accordingly the external heat exchanger 433 is heated. At the end of the defrosting operation, the ECU 460 reverses the external fan 436.

Next, controls of the external fan 436 by the ECU 460 will be described in detail with reference to FIG. 6. The ECU 460 is configured to execute the process shown in FIG. 6 at the start of the defrosting operation.

Figure 6:
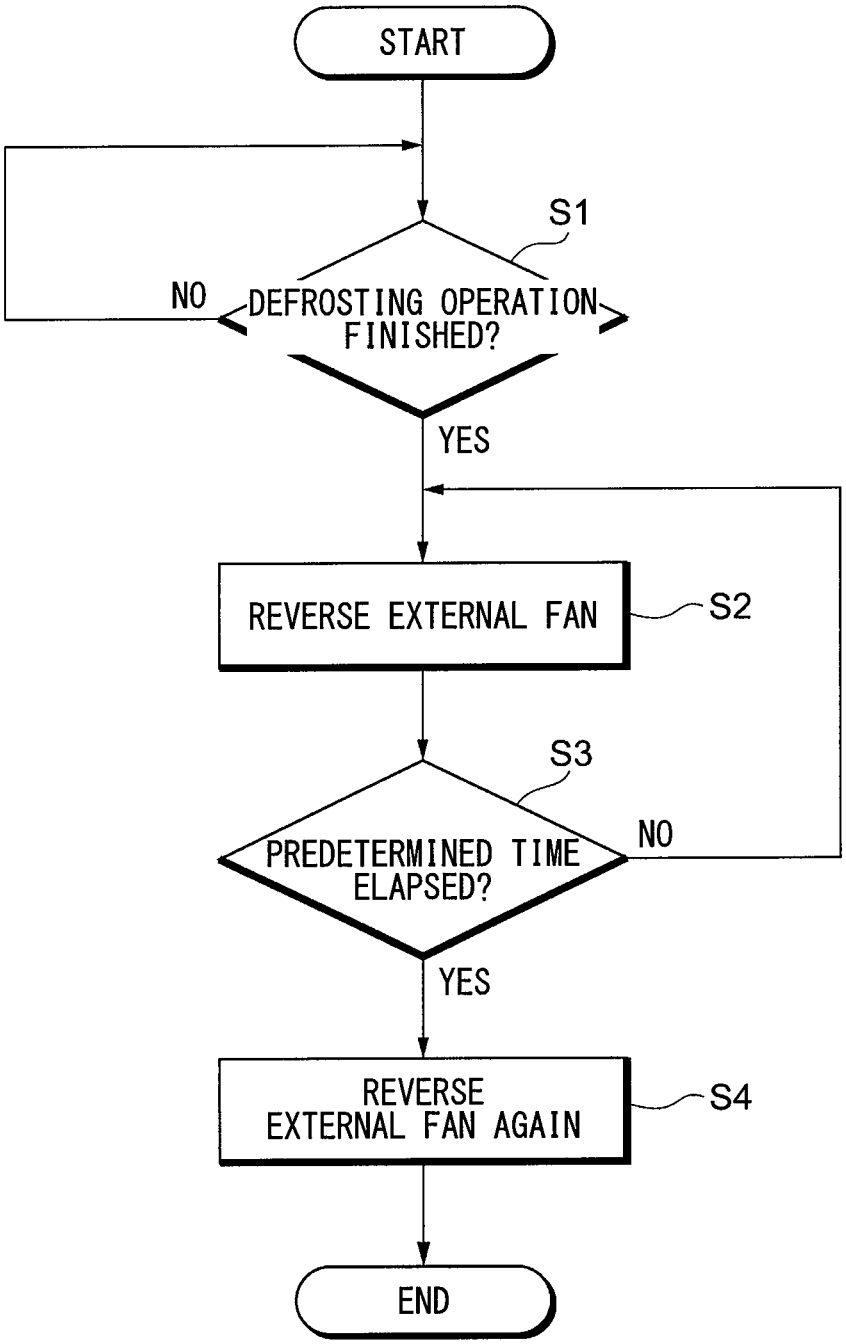
FIG. 6 is a flowchart illustrating a procedure of a process executed by an ECU according to the embodiment.

As shown in FIG. 6, the ECU 460 determines whether the defrosting operation is finished, in step S1. When the ECU 460 determines that the defrosting operation is finished (S1: YES), the ECU 460 actuates the external fan motor 437 to reverse the rotation direction of the external fan 436 in step S2. In subsequent step S3, the ECU 460 determines whether a predetermined time is elapsed from the start of the reverse rotation of the external fan 436. When the ECU 460 determines that the predetermined time is not elapsed in step S3 (S3: NO), the ECU 460 returns to step S2 to maintain the reverse rotation of the external fan 436.

When the ECU 460 determines that the predetermined time is elapsed in step S3 (S3: YES), i.e. when the predetermined time is elapsed from the start of the reverse rotation of the external fan 436, the ECU 460 returns the direction of rotation of the external fan 436.

Next, an example of actuations of the internal temperature adjusting device 400 according to the present embodiment will be described below.

When the ECU 460 performs the defrosting operation, the frost generated on the external heat exchanger 433 melts, and accordingly water droplets are generated. Since the heat exchanging member 433*c* is provided such that the air flows through the heat exchanging member 433*c* in the vertical direction as shown in FIG. 2, the water droplets generated on the heat exchanging member 433*c* are likely to move downward in the vertical direction. Accordingly, the drainage of the heat exchanging member 433*c* can be improved.

At the end of the defrosting operation, the ECU 460 reverses the external fan 436 for the predetermined time. According to this, the airflow flowing in a direction indicated by the dashed line in FIG. 2 is generated around the heat exchanging member 433*c*. That is, the air flows into the internal air passage 418 through the opening portion 415 of the housing 410 and the heat exchanging member 433*c*. Accordingly, since a downward force in the vertical direction caused by the wind generated by the external fan 436 is exerted on the water droplets generated on the heat exchanging member 433*c*, the water droplets generated on the heat exchanging member 433*c* are more likely to flow downward in the vertical direction. Therefore, the drainage of the heat exchanging member 433*c* can be further improved.

According to the internal temperature adjusting device 400 of the present embodiment described above, the following effects (1) to (4) can be obtained.

(1) The external heat exchanger 433 includes three separate heat exchanging members 433*a*, 433*b*, 433*c*. According to this configuration, flexibility in positioning of the external heat exchanger 433 can be increased. Accordingly, even when the space for the external heat exchanger 433 in the external air passage 419 is limited as in the internal temperature adjusting device 400 of the present embodiment, the heat exchanging member 433*c* can be disposed so as to achieve high drainage. Consequently, drainage of the external heat exchanger 433 as a whole can be improved. Since the frost is unlikely to be generated when the cooling operation of the heat pump 430 is restarted, and accordingly the heat exchange capacity of the external heat exchanger 433 as a whole can be maintained.

(2) The heat exchanging member 433*c* is provided such that the air flowing through the heat exchanging member 433*c* is perpendicular to the ceiling surface 202 of the container 200. Since the water droplets generated on the heat exchanging member 433*c* are likely to move downward in the vertical direction, the drainage of the external heat exchanger 433 can be further improved.

(3) When the external heat exchanger 433 functions as an evaporator, the low-temperature and low-pressure heat medium generated by the expansion valve 434 flows through, in order, the heat exchanging member 433*c*, the heat exchanging member 433*a*, the heat exchanging member 433*b* as indicated by the dashed lines in FIG. 4. Since the heat exchanging member 433*c* is cooled more than the other heat exchanging members 433*a*, 433*b*, frost may be likely to be generated on the heat exchanging member 433*c*. When frost is generated on the heat exchanging member 433*c* which has higher drainage than the heat exchanging members 433*a*, 433*b*, water droplets caused by the defrosting can be easily drained. Accordingly, since water droplets caused by the defrosting are unlikely to remain on the external heat exchanger 433 as a whole, frost is unlikely to be generated on the heat exchanging member 433*c* when the cooling operation of the heat pump 430 is restarted. Accordingly, the heat exchange capacity of the external heat exchanger 433 as a whole can be surely maintained.

(4) When the defrosting operation is finished, the ECU 460 reverses the rotation of the external fan 436 to remove water liquid generated on the heat exchanging member 433*c*. According to this, since drainage of the heat exchanging member 433*c* can be further improved, the heat exchange capacity of the external heat exchanger 433 as a whole can be surely maintained.

The above-described embodiment can be modified as described below.

Figure 7:
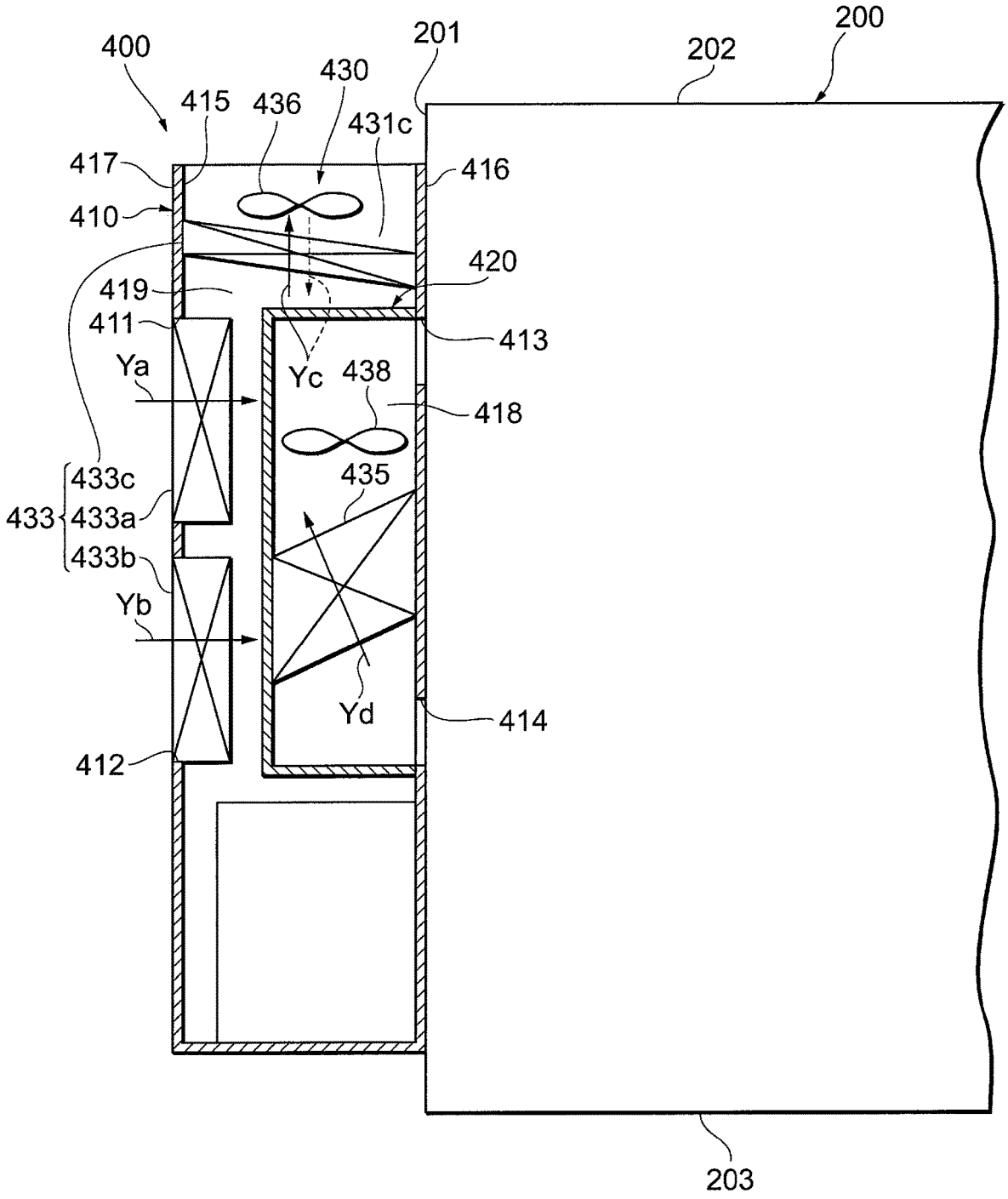
FIG. 7 is a cross-sectional diagram illustrating a structure of an internal temperature adjusting device according to a modification example.

Distribution of the heat exchanging members 433*a*, 433*b*, 433*c* can be changed as required. For example, the heat exchanging member 433*c* may be inclined such that the direction of the air flowing through the heat exchanging member 433*c* intersects with the ceiling surface 202 of the container 200 as shown in FIG. 7. The number of heat exchanging members constituting the external heat exchanger 433 can be changed as required. That is, any configuration of the external heat exchanger 433 is acceptable as long as the direction of air flowing through one inclined heat exchanging member intersects with the ceiling surface 202 of the container 200.

During or after the defrosting operation, the ECU 460 may reverse the rotation direction of the external fan 436.

The ECU 460 may not reverse the rotation direction of the external fan 436.

The internal temperature adjusting device 400 of the above-described embodiment can be used in containers other than the container 200 of the trailer 100 such as a container of an airplane.

Means and functions provided by the ECU 460 can be achieved by software stored in a tangible memory device and a computer that executes it, software only, hardware only, or a combination thereof. One of the means and functions provided by the ECU 460 may be achieved by software stored in a tangible memory device and a computer executing it, software only, hardware only, or a combination thereof. For example, when the ECU 460 is provided by an electronic circuit which is hardware, it can be provided by a digital circuit including a number of logic circuits or an analog circuit.

The present disclosure is not limited to the above specific examples. That is, those in which design modifications have been appropriately made by those skilled in the art to the above specific examples are also included in the scope of the present disclosure as long as they have the features of the present disclosure. For example, elements, arrangements, materials, conditions, shapes, sizes, and the like of the respective specific examples described above are not limited to those exemplified and can be appropriately changed. In addition, the elements included in the above-described embodiment can be combined as far as technically possible, and combinations thereof are also included in the scope of the present disclosure as long as the features of the present disclosure are included.

Although the present disclosure has been fully described in connection with the embodiment thereof, it is to be noted that various changes and modifications will become apparent to those skilled in the art. Moreover, other combinations and configurations, including more, less or only a single element, are also within the spirit and scope of the present disclosure.

What is claimed is:

1. An internal temperature adjusting device for regulating a temperature in a container, comprising:

a heat pump;

an internal heat exchanger configured to exchange heat between a heat medium and air inside the container, the internal heat exchanger being configured to function as an evaporator of the heat pump during a cooling operation for cooling the air inside the container, the internal heat exchanger being configured to function as a condenser of the heat pump during a heating operation for heating the air inside the container; and an external heat exchanger configured to exchange heat between the heat medium and air outside the container, the external heat exchanger being configured to function as a condenser of the heat pump during the cooling operation, the external heat exchanger being configured to function as an evaporator of the heat pump during the heating operation, wherein the external heat exchanger includes a plurality of heat exchanging members separated from each other, the plurality of the heat exchanging members include an inclined heat exchanging member through which the air flows in a predetermined direction intersecting with a ceiling surface of the container, and an upright heat exchanging member through which the air flows in a direction parallel to the ceiling surface of the container, and during the heating operation in which the external heat exchanger functions as the evaporator, the heat medium flows from the inclined heat exchanging member to the upright heat exchanging member.

2. The internal temperature adjusting device according to claim 1, wherein the predetermined direction is approximately perpendicular to the ceiling surface of the container.

3. The internal temperature adjusting device according to claim 1, further comprising:

an external fan closer in a vertical direction to the ceiling surface of the container than the inclined heat exchanging member is to the ceiling surface, the external fan being configured to send the air to the inclined heat exchanging member; and a controller configured to control actuations of the heat pump and the external fan, wherein the controller is configured to perform the cooling operation in which the controller actuates the heat pump such that the internal heat exchanger functions as the evaporator to cool the air inside the container, the heating operation in which the controller actuates the heat pump such that the internal heat exchanger functions as the condenser to heat the air inside the container, and a defrosting operation in which the controller actuates the heat pump to defrost the inclined heat exchanging member during the heating operation, in the cooling operation and the heating operation, the controller actuates the external fan such that the air flows through the inclined heat exchanging member toward the ceiling surface of the container, and the controller is configured to reverse a rotation direction of the external fan such that the air flows through the inclined heat exchanging member toward a bottom surface of the container, thereby removing water droplets which are generated on the inclined heat exchanging member due to the defrosting operation.

4. The internal temperature adjusting device according to claim 3, wherein in the cooling operation, the controller controls a compressor and a four-way valve such that the heat medium flows through, in order, the compressor, the external heat exchanger, and the internal heat exchanger, in the heating operation, the controller controls the compressor and the four-way valve such that the heat medium flows through, in order, the compressor, internal heat exchanger, and the external heat exchanger, and in the defrosting operation, the controller controls the compressor and the four-way valve such that the heat medium flows through, in order, the compressor, the external heat exchanger, and the internal heat exchanger.

* * * * *